United States Patent [19]

Bouillon

[11] Patent Number: 4,763,559

[45] Date of Patent: Aug. 16, 1988

[54] DEVICE FOR FEEDING AND LOADING A WEAPON WITH AMMUNITIONS IN ANY DIRECTION AND ANY ELEVATION

[75] Inventor: Jean Bouillon, Coyelaforet, France

[73] Assignee: Creusot-Loire Industrie, Paris, France

[21] Appl. No.: 61,622

[22] Filed: Jun. 15, 1987

Related U.S. Application Data

[63] Continuation-in-part of Ser. No. 752,337, Jun. 21, 1985, abandoned.

[30] Foreign Application Priority Data

Oct. 21, 1983 [FR] France ..... 83 16759

[51] Int. Cl.[4] ..... F41F 9/10

[52] U.S. Cl. ..... 89/33.04; 89/33.14; 89/36.13; 89/46

[58] Field of Search ..... 89/33.04, 45, 36.13, 89/46, 47, 34, 40.03, 33.14, 33.2, 36.08

[56] References Cited

U.S. PATENT DOCUMENTS

| | | | |
|---|---|---|---|
| 2,402,581 | 6/1946 | Ruau | 89/45 X |
| 2,905,056 | 9/1959 | Nectoux | 89/45 X |
| 2,972,934 | 2/1961 | Platt et al. | 89/46 |
| 3,387,536 | 6/1968 | Kelly et al. | 89/33.04 |
| 3,501,996 | 3/1970 | Lipp et al. | 89/46 X |
| 3,724,324 | 4/1973 | Zielinski | 89/36.13 |
| 3,901,123 | 8/1975 | Jayne et al. | 89/33.2 |
| 4,145,953 | 3/1979 | Bergling et al. | 89/46 |
| 4,329,909 | 5/1982 | Tidstrom | 89/46 |
| 4,395,936 | 8/1983 | Lunow | 89/46 |
| 4,429,616 | 2/1984 | Grosser | 89/46 X |

*Primary Examiner*—John F. Terapane
*Assistant Examiner*—John S. Maples
*Attorney, Agent, or Firm*—Pollock, Vande Sande & Priddy

[57] ABSTRACT

A device for feeding and loading a weapon with ammunitions in any direction and any elevation comprising at least one vertical rotatable magazine (20) disposed laterally of the breech (3) of the weapon (2) and formed by an endless cylinder comprising tubular receptacles (22) for the storage of the ammunitions (9), a carrier connected to the weapon (2) for taking up and transferring the ammunitions (9) between the rotatable magazine and the weapon, and a control system (7–8) controlling the position of the receptacles (22) of the cylinder in accordance with the angular position in elevation of the weapon and with the type of ammunitions. The invention is more particularly applicable to light armored cars.

6 Claims, 7 Drawing Sheets

DEVICE FOR FEEDING AND LOADING A WEAPON WITH AMMUNITIONS IN ANY DIRECTION AND ANY ELEVATION

This application is a continuation of Ser. No. 752,337, filed June 21, 1985, now abandoned.

FIELD OF THE INVENTION

The present invention relates to a device for feeding and automatically loading a weapon with ammunitions of a plurality of types, and more particularly adapted for a light armored car.

BACKGROUND OF THE INVENTION

Usually, it is customary for a gun to be carried by a turret which is orientable in direction about a vertical axis and it is itself orientable in elevation about an axis perpendicular to the axis of the turret.

According to known arrangements, the turret also comprises a system for storing ammunitions and a loading carrier which permits them to be brought in succession into the position for loading the gun. The storage of the ammunitions is usually effected in an endless rotating magazine comprising an assembly of tubular receptacles pivoted together along a support and arranged to be parallel to one another. The loading carrier ensures taking up of the ammunitions from the storage magazine and their introduction into the loading chamber of the barrel of the gun.

But, while this device permits the feeding of the gun in any angular positions of the turret, it does not permit the loading for all angular positions of the gun. Indeed, after each shot or firing, it is essential to return the weapon to a given position in elevation for the introduction of a new ammunition. This requirement obsiously affects the rapidity of the firing.

SUMMARY OF THE INVENTION

An object of the invention is to overcome this drawback by means of another arrangement which permits effecting the re-loading for all positions in elevation of the gun, thereby improving the maximum firing rates.

According to the invention, the device comprising :

(a) at least one vertical rotatable magazine which is formed by an endless cylinder comprising tubular receptacles for storing ammunitions;

(b) means connected to the weapon for taking up and transferring the ammunitions between the rotatable magazine and the weapon, said tubular receptacles being disposed laterally of a breech of the weapon and being displaceable about a support frame consisting of an upper half-cone and a lower half-cone connected laterally by two conical portions, apices of said half-cones and of said conical portions all converging toward the same common point, said half-cones and conical portions jointly forming a developable surface in the from of a circular sector so that the axes of the tubular receptacles all converge toward a point located on the vertical axis of said weapon; and (c) a system controlling the position of the tubular receptacles as a function of the angular position in elevation of the weapon and of the type of ammunitions.

According to a feature of the invention, the means for transferring the ammunitions comprise a carrier formed by a frame in which is mounted, on each side of a central opening, an endless chain supporting a pivotable block for extracting and discharging the ammunitions and diabolo-shaped members for centering said ammunitions.

BRIEF DESCRIPTION OF THE DRAWINGS

A better understanding of the invention will be had with reference to a particular embodiment of the invention which is given merely by way of example with reference to the accompanying drawings.

DESCRIPTION OF THE PREFERRED EMBODIMENTS

Figure 1:
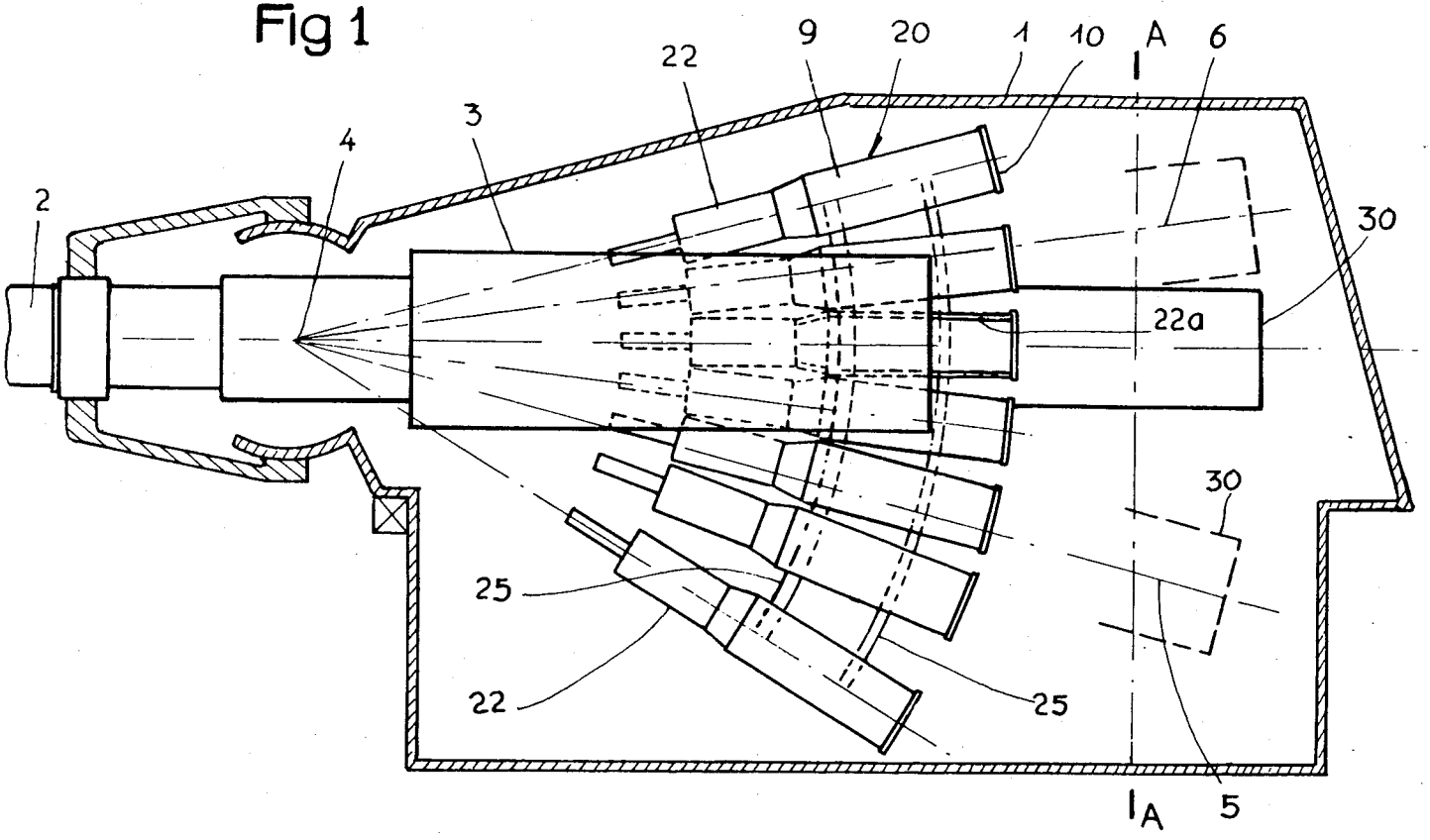
FIG. 1 is a diagrammatic cross-sectional view of a turret provided with a device for feeding and automatically loading according to the invention.
Figure 2:
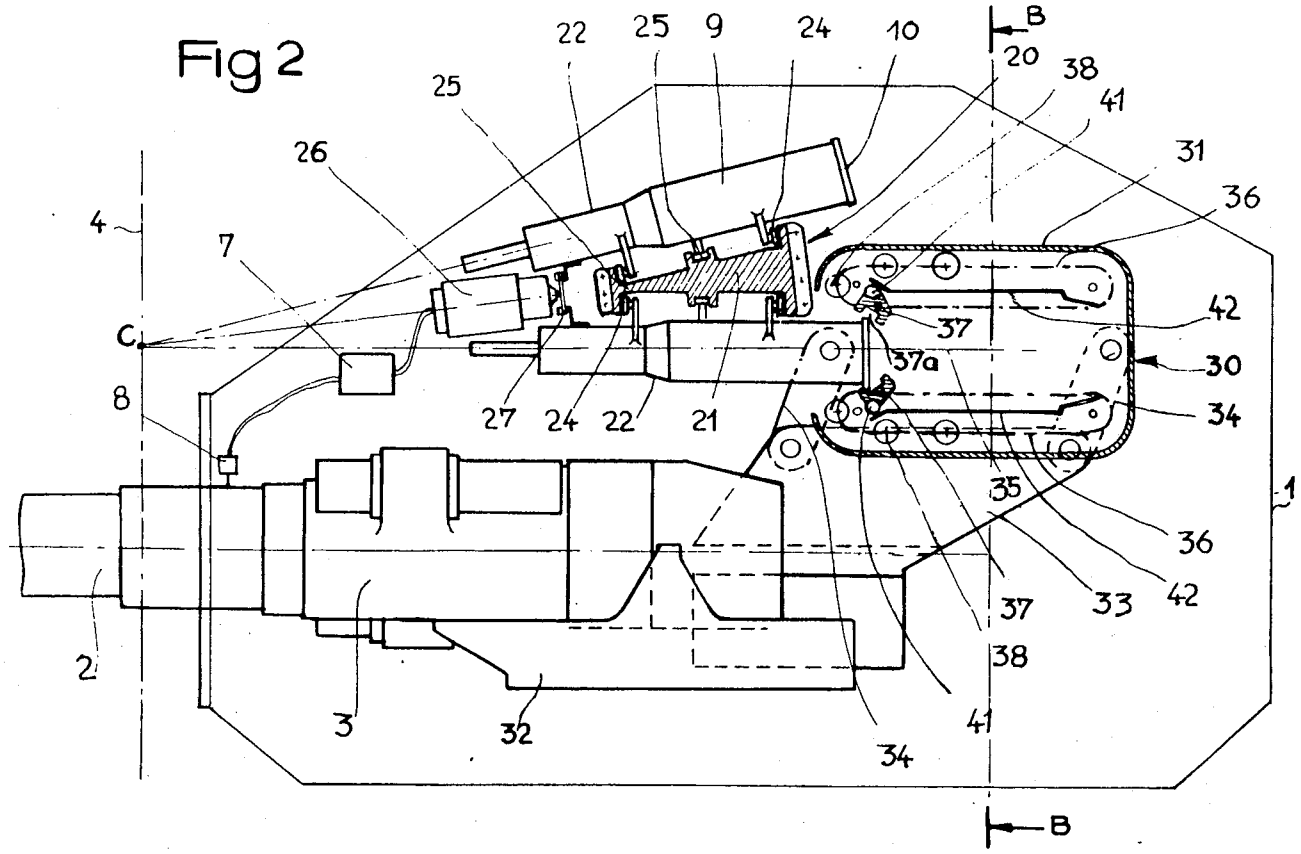
FIG. 2 is a sectional view on the firing axis of the gun shown in FIG. 1.

With reference to FIGS. 1 and 2 which show a turret 1 rotatable about a vertical axis and mounted for example on an armored vehicle, the gun 2 of the turret and its breech 3 shown in FIG. 1 for aiming at zero elevation is pivotable about the axis 4 for aiming in positive or negative elevation, for example between $+15°$ and $-8°$, as shown by the axes 5 and 6 in dot-dash lines.

Inside the turret 1, and in lateral relation to the breech 3 of the gun, there is disposed a rotatable magazine generally designated by the reference numeral 20 for storing the ammunitions. This magazine 20 is formed by an endless cylinder comprising a support frame 21.

Figure 3:
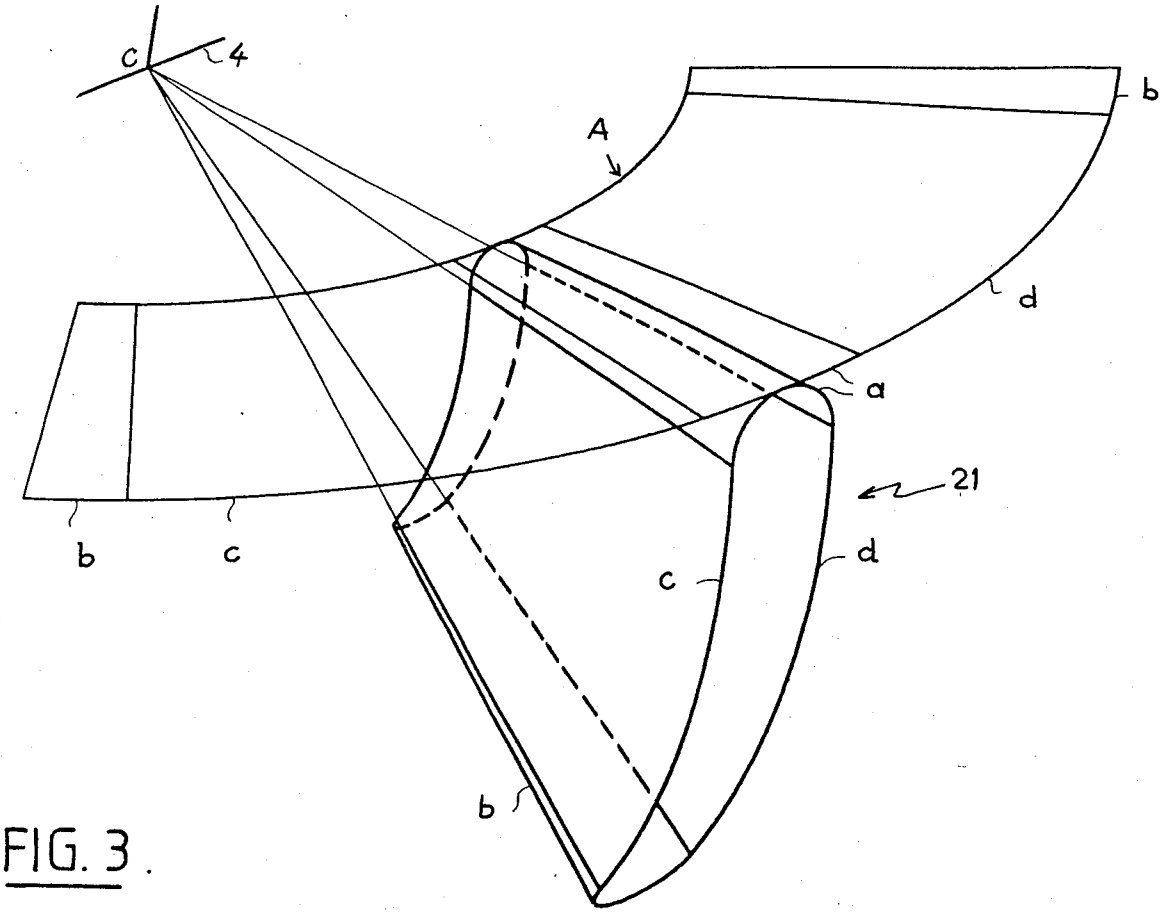
FIG. 3 shows schematically and in perspective the form of the support frame and its developed surface.

As shown in FIG. 3, the support frame 21 is formed of an upper half-cone a and a lower half-cone b whose apices converge toward a common point c located on pivot axis 4 of the gun.

The two half-cones a and b are interconnected by two conical portions c and d whose apices are common with those of half-cones a and b, i.e. they also converge toward the same common point c.

This assembly formed of half-cones a and b and conical portions c and d constitutes a developable surface in the shape of a circular sector, as shown at A in FIG. 3.

The cylinder comprises tubular receptacles 22 interconnected by connecting rods 23 (FIG. 5) provided with rolling and guiding rollers 24 which roll in rolling tracks 25 provided on the support frame 21. The continuous or intermittent displacement of the receptacles 22 about the support frame 21 is ensured by a motor speed reducer unit 26 and an endless chain 27 connected to said receptacles. The motor-speed reducer unit 26 is also connected through an electronic control and calculating unit 7 to a sensor 8 detecting the angular displacement of the gun 2. Each tubular receptacle 22, here twelve in number, contains an ammunition 9 having a flange 10; it can be loaded with ammunitions all of the same type or alternatively with ammunitions of different models. Further, the receptacles 22 are provided with a lateral opening **22*a* (FIG. 1**) for the passage of the ammunition when it is extracted, as will be seen hereinafter.

Figure 4:
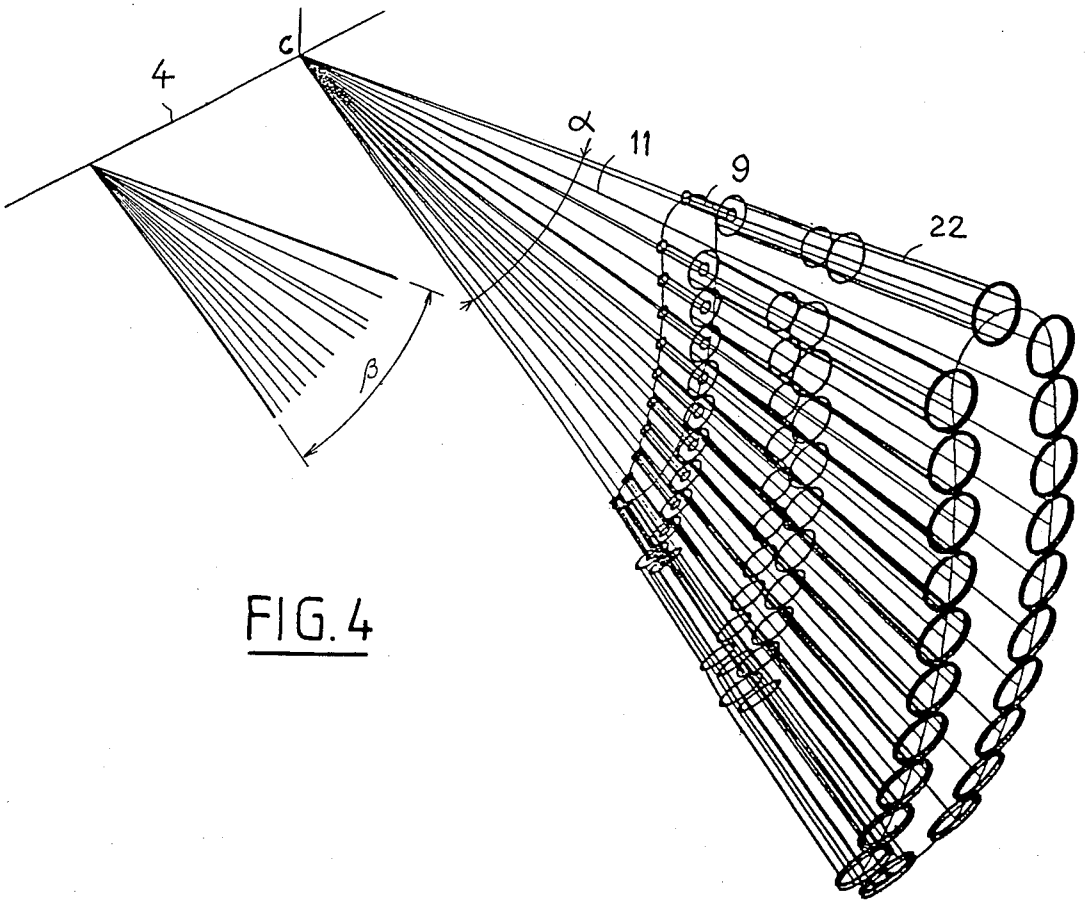
FIG. 4 is a schematic perspective view showing the position of the ammunition on the support frame.

The axes 11 of tubular receptacles 22 containing ammunitions 9 all coverge toward point c located on axis 4 (FIG. 4), the angle formed by the bundle of axes 11 being equal to the angle B corresponding to the different positions of the gun 2.

In any position of the gun 2, it is sufficient to shift receptacles 22 in one or the other direction for an ammunition to position itself rapidly on an axis parallel to that of the gun 2, without it being necessary to return the gun to a predetermined site.

Figure 6:
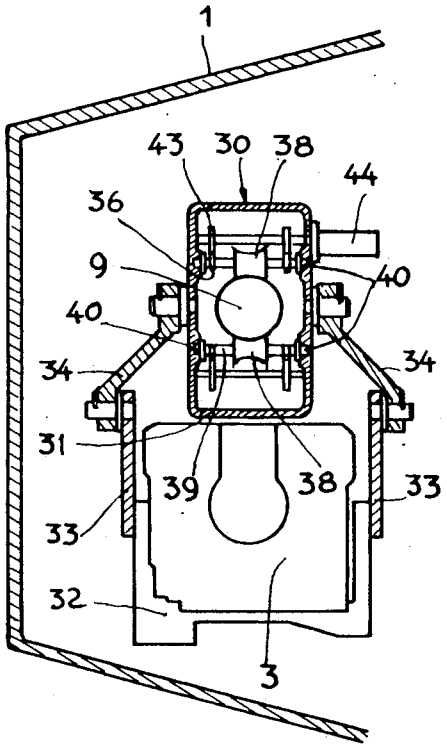
FIG. 6 is a sectional view taken on line B—B of FIG. 2.
Figure 5:
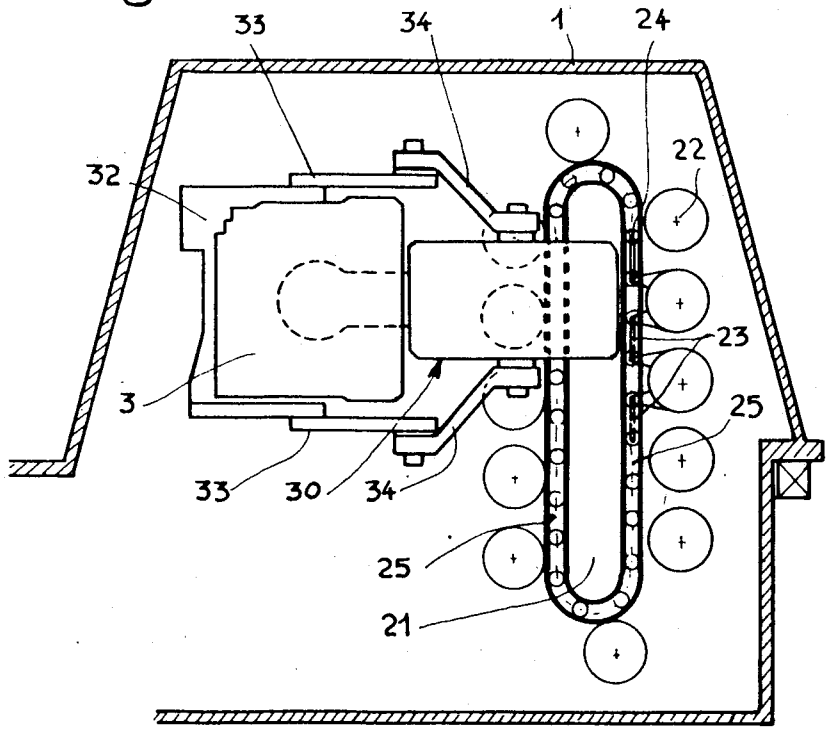
FIG. 5 is a sectional view taken on line A—A of FIG. 1.

With reference to FIGS. 2, 5 and 6, it can be seen that the transfer of the ammunitions between the magazine 20 and the gun 2 is ensured by a carrier designated by the reference numeral 30. This carrier 30 comprises a frame 31 which is pivotally connected to the cradle 32 of the gun 2 through support plates 33 and translation arms 34. Consequently, the frame 31 moves at the same time as the gun when its position is modified in elevation and pivots between a position for extracting the ammunitions 9 from the magazine 20 and a position for introducing the ammunitions into the breech 3 of the gun 2.

The frame 31 comprises a central opening 35 for introducing ammunitions 9. Inside this frame 31, endless chains 36 are provided on each side of the opening 35. Each chain supports, on one hand, an articulated block 37 for the extraction and the discharge of the ammunitions and, on the other hand, diabolo-shaped members 38 are constituted by small rollers having a concave central portion for centering said ammunitions. The diabolo-shaped members 38 are mounted on pins 39 whose ends slide in slideways 40 provided on the inner wall of the frame 31 (FIG. 6). Each block 37 is provided with a small roller 41 which moves along a shoe 42 having an inclined end and a rectilinear portion. Further, the blocks 37 include a groove 37a for seizing, driving and discharging the ammunitions 9 by means of their flange 10.

The chains 36 are driven by sprocket wheels 43 driven by a motor-speed reducer unit 44 (FIG. 6) which also produces the movement in translation of the carrier 30 through a mechanism (not shown).

The device according to the invention operates in the following manner.

The transfer of an ammunition and the loading of the gun 2 can be carried out in all positions of said gun between the two end positions on the axes 5 and 6. Indeed, the gun, in pivoting about the axis 4 for aiming in elevation, carries the carrier 30 along therewith. Further, the ammunitions 9 disposed in the receptacles 22 of the rotatable magazine 20 have their axes converging toward the point C on the axis 4. Consequently,-bearing in mind these various arrangements, whatever be the position of the gun in elevation, it is sufficient to offset in one direction or the other the receptacles 22 for an ammunition to rapidly place itself in position on an axis parallel to the axis of the gun.

Figure 7:
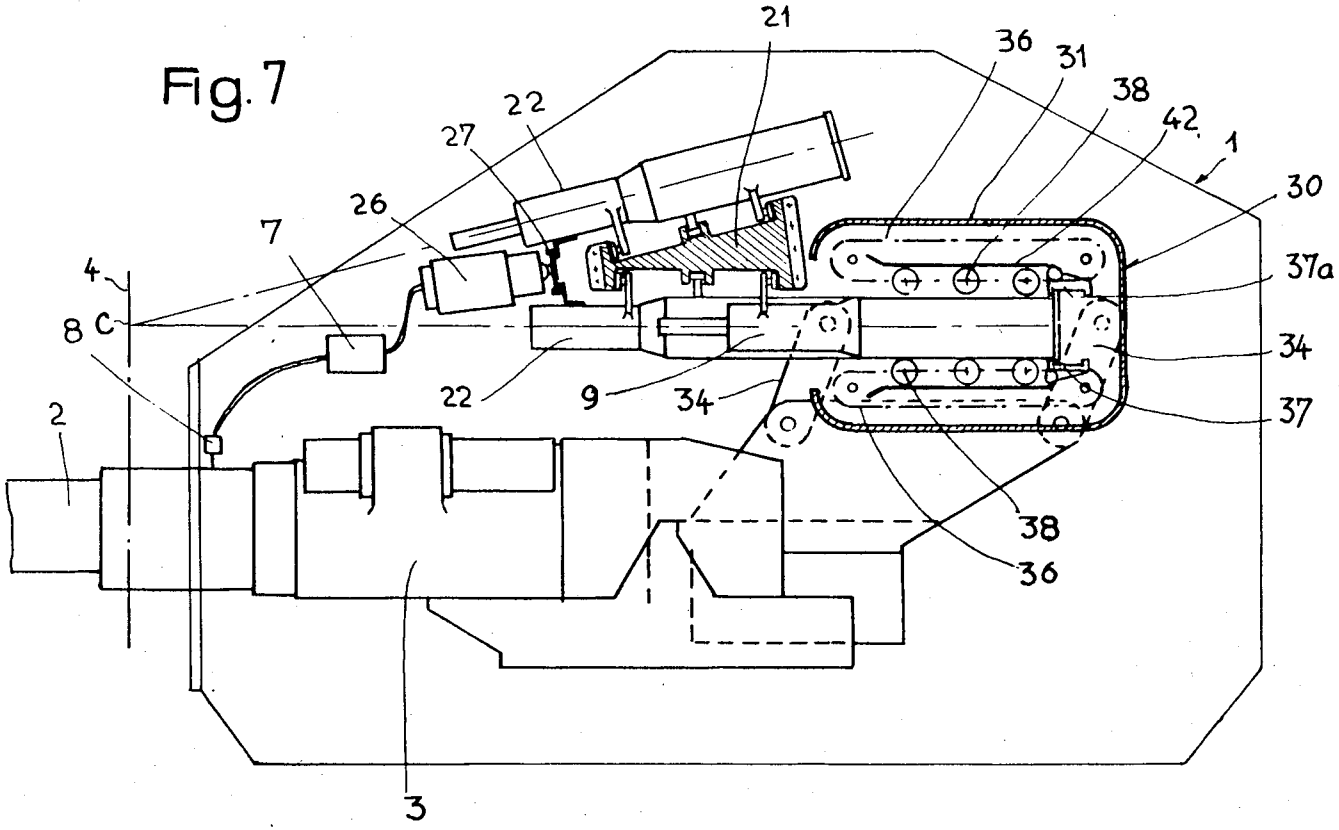
FIGS. 7 and 8 are views, similar to FIG. 2, of the various stages in the loading of an ammunition in the breech of the gun.
Figure 8:
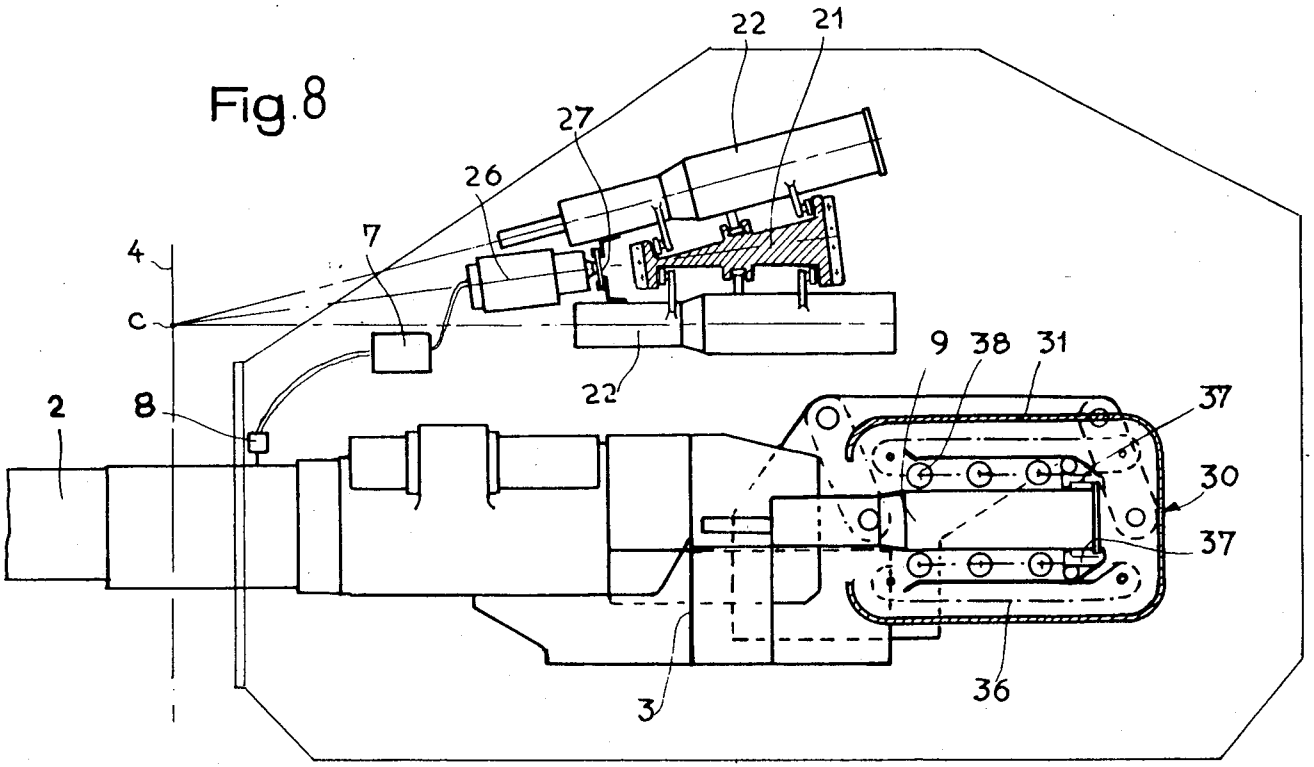

With reference to FIGS. 2, 7 and 8, there will now be described the transfer and the loading of an ammunition in the breech of the gun.

The receptacles 22 of the rotatable magazine 20 are loaded with ammunitions 9 which are all of the same type or of different types. The sensor 8 detects the angular position of the gun 2 and transmits the information to the electronic unit 7 which records it.

Simultaneously, the information concerning the type of ammunition chosen for the firing is also transmitted to the unit 7. Depending on these different parameters, the unit 7 causes the starting up of the motor-speed reducer 26 which brings about, through the chain 27, the rotation in one direction or the other of the receptacles 2 about the support frame 21 so as to bring the receptacle 22 which is the nearest and contains the chosen ammunition onto an axis parallel to the axis of elevation of the gun 2. As the carrier 30 is connected to the gun, the ammunition chosen in this way places itself in front of the opening 35 and on the axis of said carrier.

Thereafter, the unit 7 automatically commands the starting up of the motor-speed reducer unit 44 of the carrier so as to drive through the sprocket wheels 43 (FIG. 6) the chains 36 and the blocks 37 and the diabolo-shaped members 38. The displacement of the chains 36 causes the blocks 37 to pivot upon the passage of the rollers 41 on the rectilinear portion of the shoes 42. In pivoting, the grooves **37*a* of the blocks 37 clamp the flange 10 of the ammunition 9 and draws it out of its receptacle in the carrier 30 when it is centered and supported by the diabolo-shaped members 38, as shown in FIG. 7**.

As soon as the breech 3 of the gun 2 is opened (FIG. 8), the motor-speed reducer unit 4 causes, through the translation arm 34, the pivoting of the carrier 30. As the receptacles 22 are provided with a lateral opening **22*a*, the end of the ammunition 9 can be disengaged from the receptacle upon the translation of the carrier. When the carrier is positioned in front of the breech 3, the motor-speed reducer 4 drives the chains 36 in the opposite direction and the ammunition 9 is consequently discharged by the blocks 37** into the chamber of the gun. The breech is closed and the carrier starts its return movement toward the rotatable magazine for the loading of the following ammunition.

Owing to the particular form of the rotatable magazine, and to the arrangement of the transfer carrier, this device permits the feeding and the automatic loading of the gun in all its aimed positions in direction and in positive or negative elevation, so that the maximum rates of firing may be improved while a choice is available between a plurality of types of ammunitions.

The scope of the invention is not limited to the embodiment just described by way of example since it also encompasses embodiments which differ therefrom in details, in variants or by the use of equivalent means. Indeed, a rotatable magazine may be placed on each side of the weapon and, in this case, the carrier is shifted toward one or the other magazine.

I claim:

1. A device for feeding and loading in any elevation and any direction ammunitions in a weapon carried by a turret which is orientable in direction about a vertical axis, said weapon being itself orientable in elevation about an axis perpendicular to the axis of turret, said device comprising:

(a) at least one vertical rotatable magazine which is formed by an endless cylinder comprising tubular receptacles for storing ammunitions;

(b) means connected to the weapon for taking up and transferring the ammunitions between the rotatable magazine and the weapon, said tubular receptacles being disposed laterally of a breech of the weapon and being displaceable about a support frame consisting of an upper half-cone and a lower half-cone connected laterally by two conical portions, apices of said half-cones and of said conical portions all converging toward the same common point, said half-cones and conical portions jointly forming a developable surface in the form of a circular sector so that the axes of the tubular receptacles all converge toward a point located on the vertical axis of said weapon; and (c) a system controlling the position of the tubular receptacles as a function of the angular position in elevation of the weapon and of the type of ammunitions.

2. A device according to claim 1, wherein the means for transferring the ammunitions comprise a carrier formed by a frame in which is mounted, on each side of a central opening, an endless chain supporting a pivotable block for extracting and discharging the ammunitions and diabolo-shaped members for centering said ammunitions.

3. A device according to claim 2, wherein each block is provided with a small roller which is movable along a shoe including an inclined end portion followed by a rectilinear central portion for effecting the pivoting of the block upon the passage of the roller between the inclined end portion and the rectilinear portion.

4. A device according to claim 2, wherein the blocks include a groove for seizing, driving and discharging the ammunitions.

5. A device according to claim 1, wherein the control system comprises an electronic unit for recording the angular position of the weapon, detected by a sensor, and the type of ammunition chosen, and which controls a motor-speed reducer unit displacing the receptacles through a chain in a selected one of two directions so as to bring the closest receptacle containing the chosen ammunition onto an axis parallel to the axis of the weapon.

6. A device according to claim 5, wherein the electronic unit also controls a second motor-speed reducer unit for driving in succession the chains of the carrier and the translation of said carrier.

* * * * *